US009023574B2

(12) United States Patent
Wosnick et al.

(10) Patent No.: US 9,023,574 B2
(45) Date of Patent: May 5, 2015

(54) TONER PROCESSES FOR HYPER-PIGMENTED TONERS

(71) Applicant: Xerox Corporation, Norwalk, CT (US)

(72) Inventors: Jordan H. Wosnick, Toronto (CA); Melanie L. Davis, Hamilton (CA); David J. W. Lawton, Stoney Creek (CA)

(73) Assignee: Xerox Corporation, Norwalk, CT (US)

( * ) Notice: Subject to any disclaimer, the term of this patent is extended or adjusted under 35 U.S.C. 154(b) by 20 days.

(21) Appl. No.: 13/930,326

(22) Filed: Jun. 28, 2013

(65) Prior Publication Data

US 2015/0004542 A1 Jan. 1, 2015

(51) Int. Cl.
*G03G 9/08* (2006.01)

(52) U.S. Cl.
CPC ..... *G03G 9/0802* (2013.01); *G03G 9/0819* (2013.01); *G03G 9/0804* (2013.01)

(58) Field of Classification Search
CPC ..... G03G 9/0804; G03G 9/0819
USPC ..... 430/137.14
See application file for complete search history.

(56) References Cited

U.S. PATENT DOCUMENTS

| | | | |
|---|---|---|---|
| 3,590,000 | A | 6/1971 | Palermiti |
| 3,800,588 | A | 4/1974 | Larson |
| 4,298,672 | A | 11/1981 | Lu |
| 4,338,390 | A | 7/1982 | Lu |
| 5,227,460 | A | 7/1993 | Mahabadi |
| 5,278,020 | A | 1/1994 | Grushkin |
| 5,290,654 | A | 3/1994 | Sacripante |
| 5,308,734 | A | 5/1994 | Sacripante |
| 5,344,738 | A | 9/1994 | Kmiecik-Lawrynowicz |
| 5,346,797 | A | 9/1994 | Kmiecik-Lawrynowicz |
| 5,348,832 | A | 9/1994 | Sacripante |
| 5,364,729 | A | 11/1994 | Kmiecik-Lawrynowicz |
| 5,366,841 | A | 11/1994 | Patel |
| 5,370,963 | A | 12/1994 | Patel |
| 5,403,693 | A | 4/1995 | Patel |
| 5,405,728 | A | 4/1995 | Hopper |
| 5,418,108 | A | 5/1995 | Kmiecik-Lawrynowicz |
| 5,496,676 | A | 3/1996 | Croucher |
| 5,501,935 | A | 3/1996 | Patel |
| 5,527,658 | A | 6/1996 | Hopper |
| 5,585,215 | A | 12/1996 | Ong |
| 5,650,255 | A | 7/1997 | Ng |
| 5,650,256 | A | 7/1997 | Veregin |
| 5,723,253 | A | 3/1998 | Higashino |
| 5,744,520 | A | 4/1998 | Kmiecik-Lawrynowicz |
| 5,747,215 | A | 5/1998 | Ong |
| 5,763,133 | A | 6/1998 | Ong |
| 5,766,818 | A | 6/1998 | Smith |
| 5,804,349 | A | 9/1998 | Ong |
| 5,827,633 | A | 10/1998 | Ong |
| 5,840,462 | A | 11/1998 | Foucher |
| 5,853,944 | A | 12/1998 | Foucher |
| 5,863,698 | A | 1/1999 | Patel |
| 5,869,215 | A | 2/1999 | Ong |
| 5,902,710 | A | 5/1999 | Ong |
| 5,910,387 | A | 6/1999 | Mychajlowskij |
| 5,916,725 | A | 6/1999 | Patel |
| 5,919,595 | A | 7/1999 | Mychajlowskij |
| 5,925,488 | A | 7/1999 | Patel |
| 5,977,210 | A | 11/1999 | Patel |
| 6,214,507 | B1 | 4/2001 | Sokol |
| 6,593,049 | B1 | 7/2003 | Veregin |
| 6,730,450 | B1 | 5/2004 | Moffat |
| 6,743,559 | B2 | 6/2004 | Combes |
| 6,756,176 | B2 | 6/2004 | Stegamat |
| 6,780,500 | B2 | 8/2004 | Dumouched |
| 6,830,860 | B2 | 12/2004 | Sacripante |
| 7,029,817 | B2 | 4/2006 | Robinson |
| 2003/0215733 | A1 | 11/2003 | Cheng |
| 2004/0202952 | A1 * | 10/2004 | Albright et al. ..... 430/137.14 |
| 2007/0243478 | A1 | 10/2007 | Maeyama |
| 2010/0055598 | A1 | 3/2010 | Zhou |
| 2011/0250535 | A1 | 10/2011 | Vanbesien |
| 2011/0287359 | A1 | 11/2011 | Morales-Tirado |

* cited by examiner

*Primary Examiner* — Mark A Chapman
(74) *Attorney, Agent, or Firm* — Pillsbury Winthrop Shaw Pittman LLP

(57) ABSTRACT

The present embodiments relate to processes of preparing toner particles. More specifically, the processes produce toner particles having high pigment loadings and desired circularity. The processes include diluting the aggregated particulate mixture prior to coalescence.

19 Claims, No Drawings

TONER PROCESSES FOR HYPER-PIGMENTED TONERS

INTRODUCTION

The present disclosure generally relates to toner processes, and more specifically, emulsion aggregation and coalescing processes, where the resulting toner particles have high pigment loadings and desired circularity.

Emulsion aggregation/coalescing processes for the preparation of toners are illustrated in a number of patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817. The disclosures of each of the foregoing patents and publications are hereby incorporated by reference in their entirety.

High pigment loaded toners (or hyper-pigmented toners) offer printing at lower overall toner mass per unit area (TMA), thus resulting in lower toner cost per page.

However, the manufacturing process of forming hyper-pigmented toners may pose certain challenges. For example, the high pigment loading in toners may reduce the ability of the toners to spherodize during coalescence, thus causing slower toner flow during coalescence and significantly retarding the spheroidization process. Often time, the toner formation process requires longer-than-normal coalescence times, or the use of coalescence aids, such as, copper (II) nitrate, or very low pH environment during coalescence. The altered processes described above may not be ideal: extending the coalescence time results in undesirable longer overall cycle times, coalescence aid (e.g., copper (II) nitrate) addition requires treatment of subsequent filtrates to remove metal ions (e.g., $Cu^{2+}$) before discharge, and the reduction of the pH during coalescence may lead to the formation of coarse particles that reduce yield and complicate filtration.

Thus, there exists a need for a new and improved method for producing hyper-pigmented toners.

SUMMARY

According to embodiments illustrated herein, there is provided a process comprising forming a particulate mixture of latex resin, wax and colorant; aggregating the particulate mixture such that the particulate has an average particle size of from about 3.5 to about 7 microns; diluting the mixture with a liquid such that the diluted mixture contains a solid content of from about 8% to about 14% by weight based on the total weight of the diluted mixture; coalescing the diluted mixture to form toner particles; and recovering the toner particles, wherein the toner particles possess a circularity of from about 0.945 to about 0.998.

In embodiments, the present embodiments provide a process comprising forming a particulate mixture of latex resin, wax and colorant; aggregating the particulate mixture such that the particulate has an average particle size of from about 3.5 to about 7 microns; diluting the mixture with water such that the diluted mixture contains a solid content of from about 8% to about 14% by weight based on the total weight of the diluted mixture; coalescing the diluted mixture to form toner particles, wherein the coalescing occurs at a pH range from about 3.5 to about 8; and recovering the toner particles, wherein the toner particles possess a circularity of from about 0.945 to about 0.998.

In further embodiments, there is provided a process comprising forming a particulate mixture of latex resin, wax and colorant; aggregating the particulate mixture such that the particulate has an average particle size of from about 3.5 to about 7 microns; diluting the mixture with water such that the diluted mixture contains a solid content of from about 8% to about 14% by weight based on the total weight of the diluted mixture; coalescing the diluted mixture to form toner particles; and recovering the toner particles, wherein the toner particles possess a circularity of from about 0.945 to about 0.998, wherein the colorant is present in an amount of from about 3 percent to about 30 percent by weight of the toner.

DETAILED DESCRIPTION

In the following description, it is understood that other embodiments may be utilized and structural and operational changes may be made without departure from the scope of the present embodiments disclosed herein.

The present embodiments generally relate to processes for the preparation of toner particles and toner compositions. Particularly, the present embodiments relate to aggregation and coalescence processes in which small particles containing latex resin are aggregated to the appropriate toner particle size and then coalesced to achieve the final toner-particle shape and morphology. Toners of the present disclosure may be prepared with a dilution step disclosed herein performed after aggregation and prior to coalescence to reduce the solid content of the particulate mixture (i.e., toner slurry), thereby increasing the coalescence rate of the toner particles. The dilution step includes the addition of a liquid, such as water, or an aqueous solution to the particulate mixture. Surprisingly, including the dilution step in the toner particles preparation process may facilitate fast toner coalescence to achieve a circularity of greater than about 0.945, from about 0.945 to about 0.998, from about 0.955 to about 0.980, or from about 0.960 to about 0.975. Without this improved process, the toner circularity achieved in a toner, e.g., highly pigmented emulsion-aggregated toner, may be less than about 0.940.

In embodiments, the process of the disclosure does not require the addition of an exogenous acid, such as, nitric acid or hydrochloric acid. In further embodiments, the process of the disclosure does not require the addition of an exogenous acid during coalescence. In embodiments, the process of the disclosure does not require the addition of a coalescence aid, such as, transition metal salts including copper (II) nitrate, zinc nitrate, or iron nitrate.

In embodiments, toner particles and compositions may be prepared by emulsion-aggregation processes, such as a process that includes aggregating a mixture containing at least one latex resin, an optional colorant, an optional wax, and any other desired or required additives, diluting the mixture, and then coalescing the diluted aggregated mixture.

In the emulsion-aggregation process, the resulting particulate mixture (i.e., mixture of latex and other components) may be stirred and heated to a temperature at or above the glass transition temperature (Tg) of the latex, in embodiments from about 30° C. to about 70° C., in embodiments of from about 40° C. to about 65° C., in embodiments from about 45° C. to about 60° C., for a period of time from about 0.2 hours to about 6 hours, in embodiments from about 0.3 hours to about 5 hours, in embodiments from about 0.5 hours to about 3 hours. The mixture may be homogenized. If the mixture is homogenized, homogenization may be accomplished by mixing at about 1,000 to about 10,000 revolutions per minute. Homogenization may be accomplished by any suitable means, including, for example, an IKA ULTRA TURRAX T50 probe homogenizer.

The particles may be permitted to aggregate until a predetermined desired particle size is obtained. A predetermined desired size refers to the desired particle size to be obtained as determined prior to formation, and the particle size being monitored during the growth process until such particle size is reached. In embodiments, the predetermined desired particle size is from about 3.5 μm to about 6.5 μm, from about 4 μm to about 5.5 μm, or from about 4.5 μm to about 5.5 μm. (μm=micrometers) Samples may be taken during the growth process and analyzed, for example with a Coulter Counter, for average particle size. The aggregation thus may proceed by maintaining the elevated temperature, or slowly raising the temperature to, for example, from about 35° C. to about 70° C., or from about 40° C. to about 55° C., and holding the mixture at this temperature for a time from about 0.5 hours to about 6 hours, in embodiments from about 1 hour to about 5 hours, while maintaining stirring, to provide the aggregated particles.

If desired, a second mixture consisting of at least one latex resin, optionally a colorant, optionally a wax, and optionally other components, may be added to the existing particle mixture, after particles have been formed, in order to form a shell around the particles. The particles may be permitted to aggregate further with the second mixture until a predetermined desired particle size is obtained. In embodiments, the predetermined desired particle size is from about 4.5 μm to about 9.5 μm, from about 5 μm to about 7 μm, or from about 5.5 μm to about 6.5 μm. Samples may be taken during the growth process and analyzed, for example with a Coulter Counter, for average particle size. The aggregation thus may proceed by maintaining the elevated temperature, or slowly raising the temperature to, for example, from about 40° C. to about 70° C., or from about 45° C. to about 60° C., and holding the mixture at this temperature for a time from about 0.1 hours to about 1 hours, in embodiments from about 0.2 hours to about 0.7 hours, while maintaining stirring, to provide the aggregated particles.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted at an elevated temperature, for example of from about 40° C. to about 90° C., in embodiments from about 45° C. to about 80° C., which may be below the glass transition temperature of the resin as discussed above.

The resulting toner aggregates have a particle size of from about 3 microns to about 15 microns in volume average diameter, in embodiments of from about 4 microns to about 9 microns, or from about 5 microns to about 7 microns in volume average diameter.

Once the desired size of the toner particles is achieved, the growth of the toner particles may be halted. The pH of the mixture may be adjusted with a base to a value of from about 2.5 to about 7, in embodiments from about 3 to about 5.8. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 5 percent by weight of the mixture.

As solid(s) content may affects certain aspects of the aggregation-coalescence process, the present disclosure provides a toner formation process including a dilution step to reduce the solid content of a toner slurry to increase the rate of coalescence in toners. A liquid, such as, water, aqueous solutions (e.g., solutions of dilute acid in water, solutions of dilute base in water, solutions of dilute salt in water, solutions of dilute surfactant in water), can be added to the mixture of latex, colorant, optional wax, and any additives prior to coalescence. The amount of liquid is from about 2% to about 25%, from about 5% to about 20%, or from about 5% to about 15%, of the total weight of the reaction mixture. The diluted mixture may contain a solid content of from about 5% to about 25% by weight, from about 10% to about 20% by weight, or from about 10% to about 15% by weight based on the total weight of the diluted mixture. The liquid may be added to the mixture without any preheating, or preheated to a temperature of from about 35° C. to about 80° C., from about 40° C. to about 70° C., or from about 50° C. to about 60° C. prior to adding to the mixture.

The mixture of latex, colorant, optional wax, and any additives, may be subsequently coalesced. Coalescing may include stirring and heating at a temperature of from about 80° C. to about 99° C., or from about 90° C. to about 98° C. In embodiments, the coalescing step occurs for a period of from about 0.25 hours to about 4 hours or from about 0.5 hours to about 3 hours. Coalescing may be accelerated by additional stirring.

During coalescing, the pH of the toner slurry (or diluted mixture) may be adjusted to from about 3.5 to about 8.0, from about 4.0 to about 7.0, or from about 4.0 to about 5.5. Suitable acids include, for example, nitric acid, sulfuric acid, hydrochloric acid, citric acid and/or acetic acid may be used to adjust the pH of the toner slurry. The amount of acid added may be from about 0.1 to about 30 percent by weight of the mixture, and in embodiments from about 1 to about 20 percent by weight of the mixture.

The mixture may be cooled, washed and dried. Cooling may be at a temperature of from about 20° C. to about 40° C., in embodiments from about 22° C. to about 30° C., over a period of time from about 1 hour to about 8 hours, in embodiments from about 1.5 hours to about 5 hours.

In embodiments, cooling a coalesced mixture may include quenching by adding a cooling media such as, for example, ice, dry ice and the like, to effect rapid cooling to a temperature of from about 20° C. to about 40° C., in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, or by the use of jacketed reactor cooling.

The coalesced mixture may then be washed. The washing may be carried out at a pH of from about 7 to about 12, in embodiments at a pH of from about 9 to about 11. The washing may be at a temperature of from about 30° C. to about 70° C., in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

Latex Resin

Any monomer suitable for preparing a latex for use in a toner may be utilized. As noted above, in embodiments the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex resin may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-carboxyethyl acrylate), poly(styrene-butyl acrylate-acrylononitrile), poly (styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly (styrene-butyl methacrylate-acrylic acid), poly(butyl methacrylate-butyl acrylate), poly(butyl methacrylate-acrylic acid), polyacrylonitrile-butyl acrylate-acrylic acid), and mixtures thereof. The polymers may be block, random, or alternating copolymers. In addition, polyester resins which may be used include those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol.

In embodiments, a poly(styrene-butyl acrylate) may be utilized as the latex resin. The glass transition temperature of this latex, which in embodiments may be used to form a toner of the present disclosure, may be from about 35° C. to about 75° C., in embodiments from about 40° C. to about 70° C.

Surfactants

In embodiments, the latex may be prepared in an aqueous phase containing a surfactant or co-surfactant. Surfactants which may be utilized with the polymer to form a latex dispersion can be ionic or nonionic surfactants in an amount to provide a dispersion of from about 0.01 to about 15 weight percent solids, in embodiments of from about 0.1 to about 5 weight percent solids.

One or more surfactants may be utilized. The surfactants may include ionic surfactants and/or nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL Co-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™, NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecylbenzyl triethyl ammonium chloride. MIRAPOL™ and ALKAQUAT™, available from Alkaril Chemical Company, SANIZOL™ (benzalkonium chloride), available from Kao Chemicals, and the like, and mixtures thereof.

The choice of particular surfactants or combinations thereof, as well as the amounts of each to be used, are within the purview of those skilled in the art.

Initiators

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis{2-[1-(2-hydroxyethyl)-2-imidazolin-2-yl]propane}dihydrochloride, combinations thereof, and the like.

Initiators can be added in suitable amounts, such as from about 0.1 to about 8 weight percent of the monomers, and in embodiments of from about 0.2 to about 5 weight percent of the monomers. Colorants Chain Transfer Agents Charge Transfer Agents In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent of monomers, in embodiments from about 0.2 to about 5 percent by weight of monomers, and in embodiments from about 0.5 to about 3.5 percent by weight of monomers, to control the molecular weight properties of the latex polymer when emulsion polymerization is conducted in accordance with the present disclosure.

Wax

A wax may be combined with the latex resin and a colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostcarate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™. SUPERSLIP 6530™ available from Micro Powder Inc., fluorinated waxes, for example POLYFLUO 190™, POLYFLUO 200™ POLYSILK 19™, POLYSILK 14™ available from Micro Powder Inc., mixed fluorinated, amide waxes, for example MICROSPERSION 19™ also available from Micro Powder Inc. imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. pH Adjustment Agent pH Adjustment Agent In some embodiments a pH adjustment agent may be added to control the rate of the emulsion aggregation process. In embodiments, the adjustment of the pH may be utilized to adjust the final size of the toner particles. In embodiments, the adjustment of the pH may be utilized to freeze, that is to stop, toner growth.

The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof. In embodiments, ethylene diamine tetraacetic acid (EDTA) may be added to help adjust the pH to the desired values noted above.

Aggregating Agent

Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and coalescence of the particles, in embodiments the aggregating agent may be metered into the emulsion over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

Shell Resin

In embodiments, after aggregation, but prior to coalescence, a shell may be applied to the aggregated particles.

Resins which may be utilized to form the shell include, but are not limited to, the amorphous resins described above for use in the core. Such an amorphous resin may be a low molecular weight resin, a high molecular weight resin, or combinations thereof.

In some embodiments, the amorphous resin utilized to form the shell may be crosslinked. For example, crosslinking may be achieved by combining an amorphous resin with a crosslinker, sometimes referred to herein, in embodiments, as an initiator. Examples of suitable crosslinkers include, but are not limited to, for example free radical or thermal initiators such as organic peroxides and azo compounds described above as suitable for forming a gel in the core. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl 2,5-di(t-butyl peroxy)hexane, t-butyl cumyl peroxide, α-α-bis(t-butyl peroxy)diisopropyl benzene, di-t-butyl peroxide and 2,5-dimethyl 2,5di(t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy)3,3,5-trimethyl cyclohexane, 1,1-di(t-butyl peroxy)cyclohexane, 1,1-di(t-amyl peroxy)cyclohexane, 2,2-di(t-butyl peroxy)butane, ethyl 3,3-di(t-butyl peroxy)butyrate and ethyl 3,3-di(t-amyl peroxy) butyrate, and combinations thereof. Examples of suitable azo compounds include 2,2'-azobis(2,4-dimethylpentane nitrile), azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), other similar known compounds, and combinations thereof.

The crosslinker and amorphous resin may be combined for a sufficient time and at a sufficient temperature to form the crosslinked polyester gel. In embodiments, the crosslinker and amorphous resin may be heated to a temperature of from about 25° C. to about 99° C., in embodiments from about 30° C. to about 95° C., for a period of time of from about 1 minute to about 10 hours, in embodiments from about 5 minutes to about 5 hours, to form a crosslinked polyester resin or polyester gel suitable for use as a shell.

Where utilized, the crosslinker may be present in an amount of from about 0.001% by weight to about 5% by weight of the resin, in embodiments from about 0.01% by weight to about 1% by weight of the resin. The amount of CCA may be reduced in the presence of crosslinker or initiator.

A single polyester resin may be utilized as the shell or, as noted above, in embodiments a first polyester resin may be combined with other resins to form a shell. Multiple resins may be utilized in any suitable amounts. In embodiments, a first amorphous polyester resin, for example a low molecular weight amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments a second resin, in embodiments a high molecular weight amorphous resin, may be present in the shell resin in an amount of from about 0 percent by weight to about 80 percent by weight of the total shell resin, in embodiments from about 10 percent by weight to about 70 percent by weight of the shell resin.

Coalescence

The toner of the present disclosure may possess particles having a volume average diameter (also referred to as "volume average particle diameter") of from about 3 microns to about 10 microns, in embodiments from about 3.2 microns to about 8.5 microns, in embodiments from about 3.3 microns to about 7 microns, in embodiments about 5.8 microns. As noted above, the resulting toner particles may have a circularity of from about 0.945 to about 0.998, from about 0.950 to about 0.990, from about 0.955 to about 0.980, or from about 0.960 to about 0.975. When the spherical toner particles have a circularity in this range, the spherical toner particles remaining on the surface of the image holding member pass between the contacting portions of the imaging holding member and the contact charger, the amount of deformed toner is small, and therefore generation of toner filming can be prevented so that a stable image quality without defects can be obtained over a long period.

Colorants

Various known suitable colorants, such as dyes, pigments, mixtures of dyes, mixtures of pigments, mixtures of dyes and pigments, and the like, may be included in the toner. The colorant may be included in the toner in an amount of, for example, from about 3 percent to about 30 percent by weight of the toner, or from about 5 to about 25 weight percent of the toner, or from about 5 to about 20 percent by weight of the toner.

Non-limiting examples of suitable colorants include carbon black, such as REGAL 330®; magnetites, such as Mobay magnetites MO8029™, MO8060™; Columbian magnetites; MAPICO BLACKS™ and surface treated magnetites; Pfizer magnetites CB471™, CB5300™, CBS600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof are used. The pigment or pigments are generally used as water based pigment dispersions.

Specific examples of pigments include SUNSPERSE 6000. FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET I™. PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF). Sudan Blue OS (BASF), PV Fast Blue B2G01 (American Hoechst), Sunsperse Blue BHD 6000 (Sun Chemicals). Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF). Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Charge Control Agents

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

As used herein, the singular forms "a", "and," and "the" include plural referents unless the context clearly indicates otherwise.

As used herein, numerical values are often presented in a range format throughout this document. The use of a range format is merely for convenience and brevity and should not be construed as an inflexible limitation on the scope of the invention. Accordingly, the use of a range expressly includes all possible subranges, all individual numerical values within that range, and all numerical values or numerical ranges including integers within such ranges and fractions of the values or the integers within ranges unless the context clearly indicates otherwise.

It will be appreciated that varies of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Example 1

Preparation of Hyper-Pigmented Black Toner with Lower Solids during Coalescence 420 g of DI water, 185 g of poly(styrene-butyl acrylate) latex, 56 g of wax dispersion, 82 g of black pigment dispersion and 14 g of cyan pigment dispersion were added together into a 2-L glass vessel. The contents were homogenized and a flocculent of PAC and 0.02M $HNO_3$ (27 g) was added while homogenizing over 5 minute period. The slurry was then heated to 53° C. while under constant agitation at 200 RPM. When the particle size reached 4.5-4.8 microns, 105 g of shell latex was added. When the particle size reached 5.4-5.9 microns, 4% NaOH was added to adjust the slurry to pH 3.3, 3.62 g of Dow VERSENE (EDTA solution) was added to bring the slurry to pH 4.5, and a further quantity of 4% NaOH to pH 5.5. Stirring was adjusted down to 170 RPM. After 10 minutes, 330 g of DI water pre-heated to 55° C. was added to the slurry, which was then heated to 96° C. During the temperature ramp-up, the pH was adjusted down to 4.3 at 85° C. using 0.3M $HNO_3$. After reaching 96° C., samples of the slurry were taken every 30 minutes to determine circularity. When the circularity reached 0.953-0.963, the pH was adjusted up to 7.0 using 4% NaOH. After a total of 3 hours, full cooling was applied to the slurry. When the temperature reached 68° C., pH was adjusted to 8.8 using 4% NaOH. Full cooling was continued and the slurry was discharged when temperature dropped below 40 C. The resulting toner particles had particle size (D50) 5.654 μm, GSDv/n 1.207/1.219, and circularity 0.968.

Example 2

Preparation of Hyper-Pigmented Cyan Toner with Lower Solids During Coalescence

The procedure of Example 1 was followed, except 81 g of cyan pigment dispersion was used in place of the combined black and cyan pigment dispersions mentioned in that example. The resulting toner particles had particle size (D50) 5.654 μm, GSDv/n 1.207/1.246, and circularity 0.966.

Example 3

Counter Example

Preparation of Hyper-Pigmented Black Toner Using Standard Techniques

The procedure of Example 1 was followed during the aggregation phase. After addition of Dow VERSENE (EDTA solution), 4% NaOH was added to adjust the slurry to pH 5.0, which was then heated to 96° C. Stirring was adjusted down to 200 RPM. No further addition of water was performed during temperature ramp-up. On reaching 70° C. during the temperature ramp-up, 0.3M $HNO_3$ was added to adjust the slurry pH to 4.0. After one hour at 96° C., visual inspection indicated poor coalescence. The slurry was adjusted to pH 3.6 and then further down to pH 3.0 after two hours at 96° C. When the three hours of coalescence were complete, the toner particles had circularity 0.940.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. A process comprising:

forming a particulate mixture of latex resin, wax and colorant;

aggregating the particulate mixture such that the particulate has an average particle size of from about 3.5 to about 7 microns;

diluting the mixture with a liquid after the step of aggregating, such that the diluted mixture contains a solid content of from about 8% to about 14% by weight based on the total weight of the diluted mixture;

coalescing the diluted mixture to form toner particles; and recovering the toner particles, wherein the toner particles possess a circularity of from about 0.945 to about 0.998.

2. The process of claim 1, wherein the latex resin is selected from the group consisting of styrenes, acrylates, methacrylates, butadienes, isoprenes, acrylic acids, methacrylic acids, acrylonitriles, and mixtures thereof.

3. The process of claim 2, wherein the latex resin is selected from the group consisting of styrene acrylates, styrene butadienes, styrene methacrylates, and mixtures thereof.

4. The process of claim 3, wherein the latex resin comprises styrene acrylates.

5. The process of claim 1, wherein the liquid is selected from the group consisting of water, water-miscible solvent, and mixtures thereof.

6. The process of claim 1, wherein the liquid comprises water.

7. The process of claim 1, wherein the coalescing step occurs at a temperature of from about 80° C. to about 99° C.

8. The process of claim 1, wherein the coalescing step occurs for a period of from about 0.25 hours to about 4 hours.

9. The process of claim 1, wherein the coalescing step occurs at a pH range from about 3.5 to about 8.0.

10. The process of claim 1, wherein the process does not include the addition of an exogenous acid.

11. The process of claim 1, wherein the process does not include the addition of a coalescing agent.

12. The process of claim 1, wherein the colorant comprises dyes, pigments, combinations of dyes, combinations of pigments, or combinations of dyes and pigments.

13. The process of claim 12, wherein the colorant is selected from the group consisting of black, cyan, magenta, yellow, and mixtures thereof.

14. The process of claim 1, wherein the colorant is present in an amount of from about 3 percent to about 30 percent by weight of the toner.

15. The process of claim 1, wherein the toner particles possess a volume average diameter of from about 3 microns to about 10 micron.

16. A process comprising:

forming a particulate mixture of latex resin, wax and colorant;

aggregating the particulate mixture such that the particulate has an average particle size of from about 3.5 to about 7 microns;

diluting the mixture with water such that the diluted mixture contains a solid content of from about 8% to about 14% by weight based on the total weight of the diluted mixture;

coalescing the diluted mixture to form toner particles, wherein the coalescing occurs at a pH range from about 3.5 to about 8; and recovering the toner particles, wherein the toner particles possess a circularity of from about 0.945 to about 0.998.

17. The process of claim 16, wherein the latex resin is selected from the group consisting of styrene acrylates, styrene butadienes, styrene methacrylates, and mixtures thereof.

18. The process of claim 16, wherein the colorant is present in an amount of from about 3 percent to about 30 percent by weight of the toner.

19. A process comprising:

forming a particulate mixture of latex resin, wax and colorant;

aggregating the particulate mixture after the step of aggregating, such that the particulate has an average particle size of from about 3.5 to about 7 microns;

diluting the mixture with water such that the diluted mixture contains a solid content of from about 8% to about 14% by weight based on the total weight of the diluted mixture;

coalescing the diluted mixture to form toner particles; and recovering the toner particles, wherein the toner particles possess a circularity of from about 0.945 to about 0.998, wherein the colorant is present in an amount of from about 3 percent to about 30 percent by weight of the toner.

* * * * *